US008814467B2

(12) United States Patent
Dawson et al.

(10) Patent No.: US 8,814,467 B2
(45) Date of Patent: Aug. 26, 2014

(54) FLAME INDICATOR

(75) Inventors: Charles W. Dawson, Big Lake, MN (US); Barry W. Mattson, Elk River, MN (US); Thomas L. Triplett, Rockford, MN (US); Steven H. Fredrickson, Minneapolis, MN (US); Christopher A. Lins, Crystal, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 13/980,253

(22) PCT Filed: Jan. 19, 2012

(86) PCT No.: PCT/US2012/021834

§ 371 (c)(1),
(2), (4) Date: Jul. 17, 2013

(87) PCT Pub. No.: WO2012/100026

PCT Pub. Date: Jul. 26, 2012

(65) Prior Publication Data

US 2013/0294832 A1 Nov. 7, 2013

Related U.S. Application Data

(60) Provisional application No. 61/434,053, filed on Jan. 19, 2011.

(51) Int. Cl.

| | |
|---|---|
| ***E01C 23/14*** | (2006.01) |
| ***E01C 23/16*** | (2006.01) |
| ***F23N 5/02*** | (2006.01) |

(52) U.S. Cl.

CPC .. *E01C 23/16* (2013.01); *F23N 5/02* (2013.01)

USPC ..... 404/95; 404/77; 404/79; 431/13

(58) Field of Classification Search

CPC ..... E01C 23/16; F23N 5/02

USPC ..... 404/75, 77, 79, 93–95; 431/13

See application file for complete search history.

(56) References Cited

U.S. PATENT DOCUMENTS 3,964,835 A * 6/1976 Eigenmann ..... 404/94
4,623,279 A 11/1986 Smith (Continued)

FOREIGN PATENT DOCUMENTS

JP 2000054317 A 2/2000
WO WO94/26982 A1 11/1994

OTHER PUBLICATIONS

The International Search Report and Written Opinion in counterpart International Application No. PCT/US2012/021834 filed Jan. 19, 2012.

*Primary Examiner* — Raymond W Addie
(74) *Attorney, Agent, or Firm* — Kinney & Lange, P.A.

(57) ABSTRACT

A flame safety system for a thermoplastic applicator comprises a gas burner and a flame indicator. The gas burner expels a jet of pressurized combustible gas from an outlet nozzle, and includes an attachment groove near the nozzle. The flame indicator includes an attachment ring configured to fit into the groove, thereby securing the flame indicator to the gas burner, and a flame path portion extending from the attachment ring into the jet of pressurized combustible gas. The flame path portion is formed from a material which incandescently glows whenever the jet of combustible pressurized gas is lit.

20 Claims, 5 Drawing Sheets

(56) References Cited

U.S. PATENT DOCUMENTS

| | | | | |
|---|---|---|---|---|
| 4,946,384 | A * | 8/1990 | London | 431/349 |
| 5,188,451 | A * | 2/1993 | Shanks | 362/223 |
| 5,218,952 | A * | 6/1993 | Neufeldt | 126/92 AC |
| 5,599,133 | A * | 2/1997 | Costello et al. | 404/72 |
| 5,607,254 | A * | 3/1997 | Grembowicz et al. | 404/79 |
| 5,642,962 | A * | 7/1997 | Marcato | 404/94 |
| 6,547,158 | B1 * | 4/2003 | Smith | 239/150 |
| 6,585,408 | B2 * | 7/2003 | El-Gabry et al. | 374/43 |
| 6,742,959 | B2 * | 6/2004 | Strassman | 404/95 |
| 7,252,455 | B2 * | 8/2007 | Larsen | 404/95 |
| 2001/0030244 | A1 * | 10/2001 | Schroeder et al. | 239/146 |
| 2007/0116516 | A1 | 5/2007 | Lichtblau | |
| 2009/0087263 | A1 * | 4/2009 | Martinez et al. | 404/94 |

* cited by examiner

FLAME INDICATOR

BACKGROUND

The present invention relates generally to fire safety, and more particularly to a flame indicator for a mobile applicator for marking pavement with thermoplastics.

Alkyd and hydrocarbon thermoplastics are commonly used to mark pavement surfaces with visible lines and symbols such as lane dividers and guide lines. In particular, thermoplastics provide a durable alternative to pavement painting, and are commonly used to mark street intersections, parking lots, and other high-traffic pavement surfaces from which paint would quickly wear away.

Thermoplastics are conventionally applied to pavement surfaces using a mobile applicator comprising a heated reservoir or kettle, and an application screed die. Melted thermoplastic is dispensed from the kettle at a controlled rate and applied in a thin layer atop pavement surfaces with the screed die. Some applicators further comprise secondary burners which heat secondary reservoirs or screed die. Many applicators burn pressurized gas, such as propane and butane, at secondary burners and to heat applicator kettles. Manually driven and self-powered applicators are both relatively common, and some applicators can be attached to and driven by vehicles.

Burners for thermoplastic melters and applicators typically operate by releasing a jet of pressurized combustible gas. When lit, this gas acts as a torch which is directed at components to be heated, such as the applicator kettle or screed die. Unlit jets of pressurized gas can constitute a serious safety hazard, rapidly releasing dangerous quantities of combustible gas into the air. Flames on gas burners can be pale and difficult to see, particularly in bright light, making it difficult for mobile applicator operators to ascertain whether a gas jet is lit (and therefore safe) or unlit (and therefore potentially dangerous).

SUMMARY

The present invention is directed toward a flame safety system for a thermoplastic applicator. The flame safety system comprises a gas burner and a flame indicator. The gas burner expels a jet of pressurized combustible gas from an outlet nozzle, and includes an attachment groove near the nozzle. The flame indicator includes an attachment ring configured to fit into the groove, thereby securing the flame indicator to the gas burner, and a flame path portion extending from the attachment ring into the jet of pressurized combustible gas. The flame path portion is formed from a material which incandescently glows whenever the jet of combustible pressurized gas is lit.

DETAILED DESCRIPTION

The present invention relates to a flame indicator described below with respect to FIGS. 4 and 5. This flame indicator is used in mobile thermoplastic applicators. To place the invention in perspective, FIGS. 1, 2, and 3 are included to provide an overview of such a mobile applicator.

Figure 1:
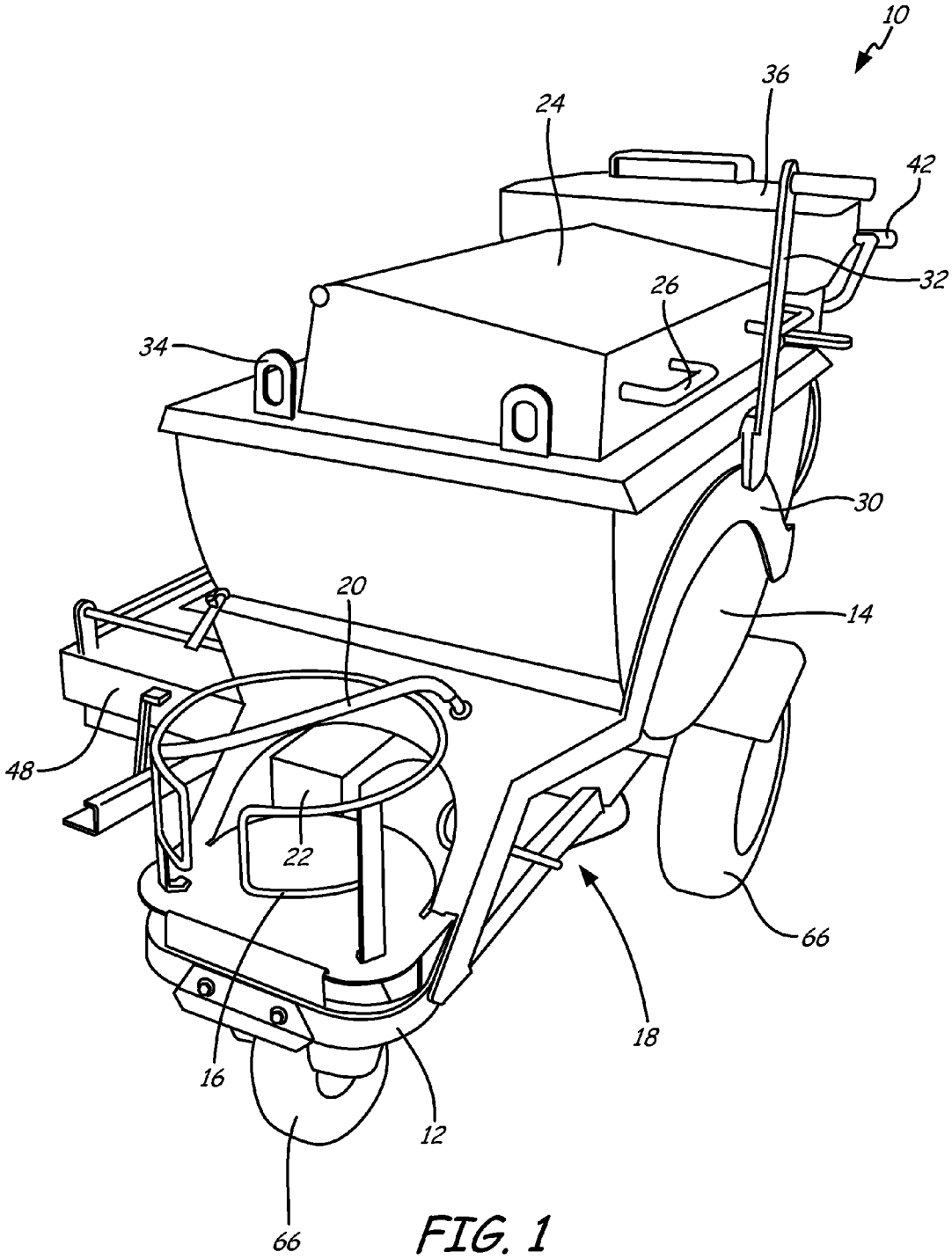
FIG. 1 is a first perspective view of a mobile applicator of the present invention.
Figure 2:
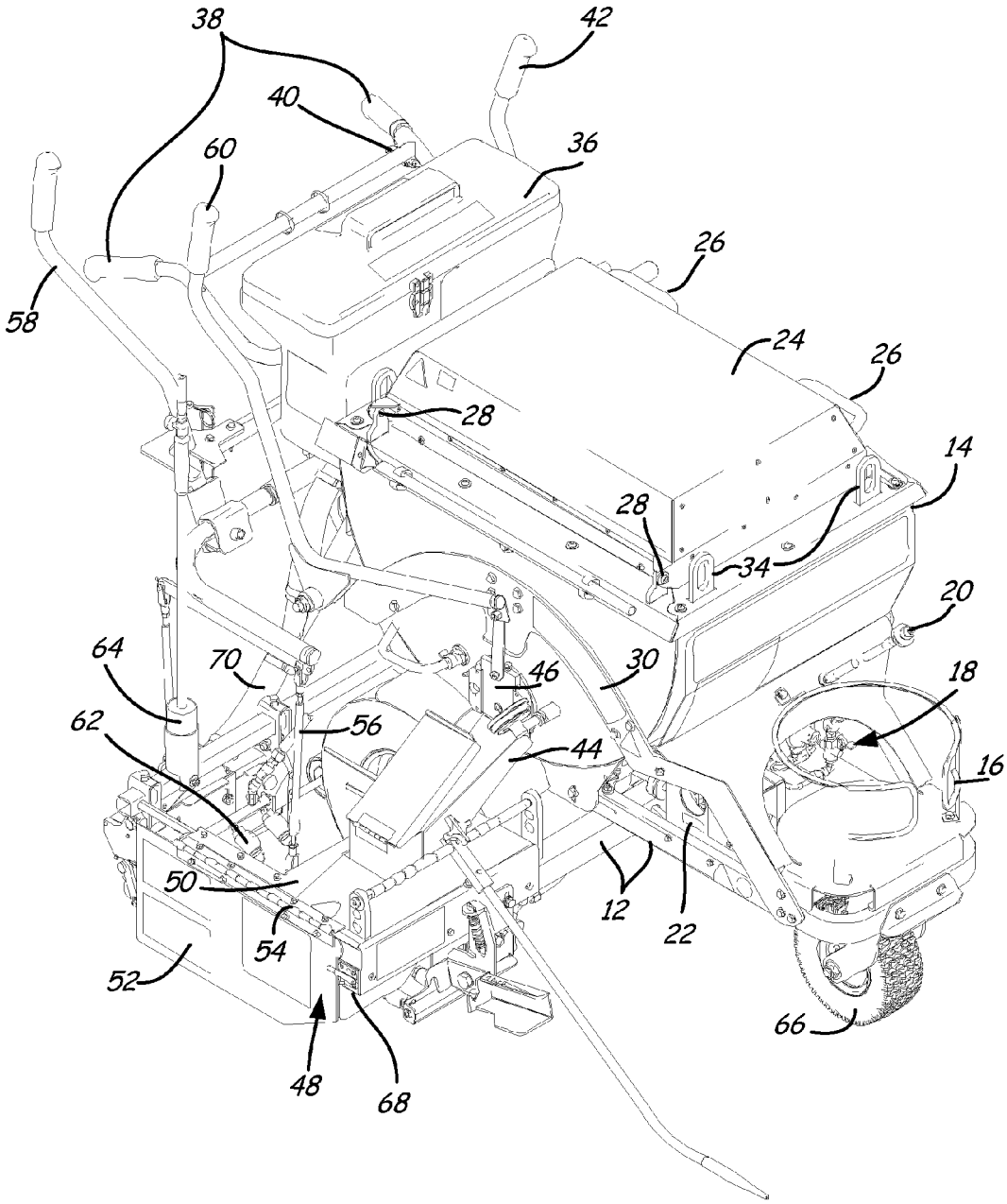
FIG. 2 is a second perspective view of the mobile applicator of FIG. 1.
Figure 3:
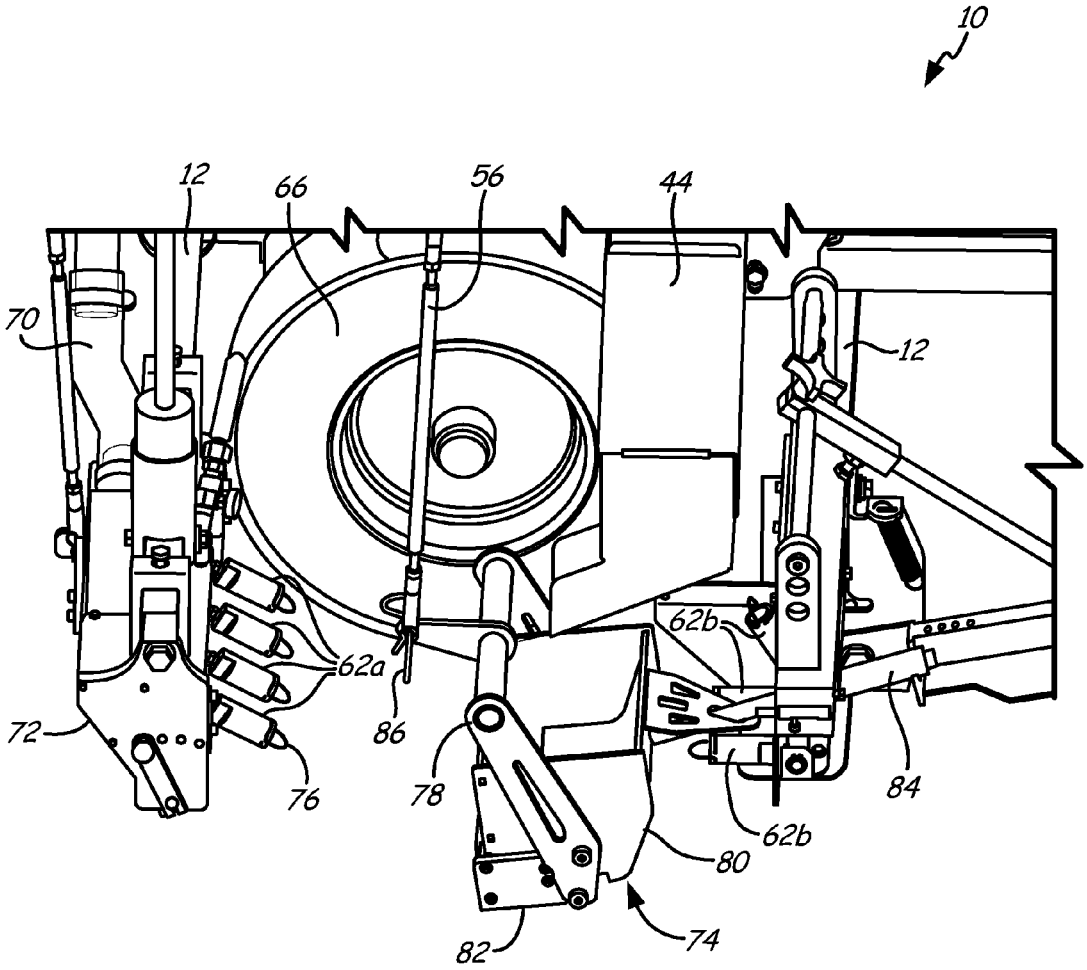
FIG. 3 is a perspective view of a screed die box of the mobile applicator of FIG. 1 and surrounding components.

FIGS. 1 and 2 are perspective views of mobile applicator 10 that will be discussed simultaneously. Mobile applicator 10 comprises frame 12, kettle 14, gas tank cradle 16, gas system 18 (with gas tank hookup 20 and gas safety valve 22), kettle lid 24 (with lid handles 26 and lid hinges 28), kettle supports 30, agitator arm 32, lifting eyes 34, bead reservoir 36, push bar 38 (with handbrake 40), agitator lever 42, chute 44, gate valve 46, screed enclosure 48 (with screed enclosure top 50 and screed shroud door 52 connected at shroud door hinges 54), screed actuator link 56, screed actuator lever 58, gate valve lever 60, screed box burners 62, hand torch 64, wheels 66, shroud door latch 68, and bead tube 70.

Mobile applicator 10 is a tool capable of marking pavement lines by melting and then applying thermoplastic a pavement surface. Mobile applicator 10 includes frame 12 which provides support for other components of mobile applicator 12. Frame 12 may, for instance, be comprised of a framework of aluminum and/or steel beams, tubes, and struts. Gas tank cradle 16 is attached to frame 12 at the forward end of frame 12. Gas tank cradle 16 is a holding structure sized to retain a tank of propane, butane, or other appropriate combustible gas. Wheels 66 are rotatably attached to the bottom of frame 12 and allow mobile applicator 10 to move along pavement. In the depicted embodiment, mobile applicator 10 includes three wheels 66: a single front wheel which swivels and provides directional control, and two rear wheels which track behind the front wheel. Push bar 38 is attached at the aft of frame 12 and includes handbrake 40. Push bar 38 allows a user to propel mobile applicator 10 and handbrake 40 allows the user to stop applicator 10, such that the user can direct where the pavement lines are made. One skilled in the art can appreciate that although directional terms such as "forward", "aft", "bottom", "top", "right side", and "left side" have been used in describing this invention, but such terms are merely relational descriptors of the illustrated embodiments shown herein.

Mounted to the top of frame 12 is kettle 14, which is a receptacle that is heated to melt granular thermoplastic for application to pavement surfaces. In the illustrated embodiment, kettle 14 is a substantially hemi-cylindrical receptacle heated from below by a plurality of gas burners. Kettle 14 may, for instance, be formed of aluminum. Kettle 14 is attached to frame 12 via kettle supports 30, which are rigid struts or surfaces formed, for instance, of steel or aluminum.

Kettle lid 24 covers the open top of kettle 14 and prevents molten thermoplastic, thermoplastic vapor, and heat from escaping from kettle 14 during operation. Kettle lid 24 can be opened and closed with lid handles 26, which are attached to the left side of kettle lid 24. In some embodiments, kettle 14 may include latches which allow kettle lid 24 to be locked shut. Kettle lid 24 is connected to kettle 14 via lid hinges 28 which are on the right side of kettle lid 24 (opposite of lid handles 26). Lid hinges 28 may be any sort of conventional hinge selected for heat resilience and resistance to fouling when exposed to melted thermoplastic. In addition, kettle 14 includes agitator arm 32 which is connected to a plurality of agitators inside kettle 14 used to stir the molten thermoplastic.

Also attached to the top of kettle 14 are lifting eyes 34. Lifting eyes 34 are attachment points that allow mobile applicator 10 to be hoisted into position or loaded onto or off of a transportation vehicle. In the illustrated embodiment, lifting eyes 34 are tabs with holes which extend from the top surface of kettle 14, but a person skilled in the art will recognize that lifting eyes 34 may generally be any sort of load-bearing anchors for a hoist or crane, and could, for instance, be located on frame 12, instead.

At the bottom right side of kettle 14 is gate valve 46. Gate valve 46 is positioned between the interior of kettle 14 to chute 44. Chute 44 is a rigid, heat-resistant chute or trough which guides molten thermoplastic from kettle 14 to the screed die box. Chute 44 is comprised of a heat-resistant material including, but not limited to, aluminum or steel.

As stated previously, gas tank cradle 16 holds a tank of combustible gas (not shown), and gas from this tank is utilized by gas system 18. Gas system 18 is largely located beneath kettle 14 and kettle supports 30, and is anchored to frame 12. Gas system 18 includes gas hookup 20, a fluid connection which receives gas from a tank at gas tank cradle 16. Gas system 18 also includes gas safety valve 22, and a plurality of other valves and gas distribution tubes. Gas safety valve 22 is an electrically actuated multi-path valve which controls gas flow to pilot burners and main burners heating kettle 14. Gas system 18 provides combustible gas to burners which heat kettle 14, and to screed box burners 62 and hand torch 64. Hand torch 64 is a handheld burner which can be used by a human operator to touch up or remove thermoplastic applied using mobile applicator 10 and is therefore located at the aft of mobile applicator 10. In addition, screed box burners 62 are connected to gas system 18.

Screed enclosure 48 is anchored to frame 12 at the bottom right side of frame 12. Screed enclosure 48 includes screed enclosure top 50 and screed shroud door 52. Screed enclosure 48 surrounds screed box burners 62 and the screed die box (see FIG. 3, below). Screed enclosure top 50 partially covers the screed die box, and screed shroud door 52 is connected to screed enclosure top 50 by shroud door hinges 54, such that screed shroud door 52 can be pivoted upward from door hinges 54 to reach, remove, or insert the screed die box. Screed shroud door 52 is secured to frame 12 by shroud door latch 68, which holds shroud door 52 in the depicted (closed) position during operation of mobile applicator 10. Screed enclosure 48 shields the screed die box from wind and debris and conversely shields the operator from the molten thermoplastic therein.

In order to operate mobile applicator 10, a user ignites pilot burners and main burners under kettle 14. Then the user opens kettle lid 24 and deposits a sack of granular thermoplastic atop heat exchanger plenums located inside kettle 14. The sack itself is formed of a meltable thermoplastic material, so heat from main burners 116 melts the sack and the granules. The user can then rotate agitator arm 32 back and forth across a substantially 180° range, thereby sweeping the agitators through the interior of kettle 14 so as to mix the thermoplastic as it melts. Alternatively, the user can attach agitator arm 32 to agitator lever 42, allowing the user to move agitator arm 32 from the aft of mobile applicator 10.

Once the thermoplastic is uniformly melted, the user can pull gate valve lever 60, which opens gate valve 36. Opening gate valve 36 allows thermoplastic from kettle 14 to flow down chute 44 into the screed die box (shown in FIG. 3). Screed box burners 62 heat the screed die box, allowing the thermoplastic to remain molten as it is dispensed. In addition, light reflective beads are commonly used to provide increased visibility to thermoplastic stripes, for some applications. These beads, which are usually formed of glass, are deposited on freshly applied molten thermoplastic. Some embodiments of mobile applicator 10 include bead reservoir 36 (located at the top aft of mobile applicator 10), which is a receptacle for storing such glass beads. Bead tube 70 carries beads from bead reservoir 36 to screed enclosure 48, allowing beads to be deposited as thermoplastic is applied.

The components and configuration of mobile applicator 10 as shown in FIGS. 1 and 2 allow for a bag of thermoplastic granules to be transformed into a pavement line. This occurs by mobile applicator 10 melting the thermoplastic in kettle 14, transferring the melted thermoplastic into a screed die (shown in FIG. 3) via gate valve 46 and chute 44, and dispensing the molten thermoplastic onto the pavement. A pavement line is formed as the user propels mobile applicator 10.

FIGS. 1 and 2 depict one embodiment of the invention, to which there are alternatives. For example, mobile applicator 10 can include mounting points such that mobile applicator 10 can be attached to a motor vehicle. In such an embodiment, the motor vehicle pushes and/or pulls mobile applicator 10 in order to direct where the pavement lines are made.

FIG. 3 provides a close-up view of die box 74 and surrounding components of mobile applicator 10, with screed enclosure 48 removed for increased visibility. FIG. 3 depicts frame 12, chute 44, screed actuator link 56, screed burners 62 (including four aft screed burners 62*a* and three fore burners 62*b*), wheel 66, bead tube 70, bead dispenser 72, screed die box 74, and flame indicators 76. Screed die box 74 comprises screed die box lever 78, screed die box bucket 80, screed die box gate 82, screed die box anchor 84, and retention pin 86.

As stated above with respect to FIGS. 1 and 2, screed die box 74 is positioned beneath chute 44 in order to receive molten thermoplastic from chute 44. Screed die box 74 is primarily comprised of screed die bucket 80, a five-sided container open on top to receive thermoplastic from chute 44. Screed die bucket 80 is anchored relative to other components of mobile applicator 10 by screed die box anchor 84, which is welded to or integrally formed on the forward side of bucket 80. In the illustrated embodiment, screed die box anchor 84 is an elongate post which extends through and can be locked into place relative to frame 12. Screed die box anchor 84 can be locked in place to frame 12 anywhere along the length of die screed die box anchor 84, allowing the position of screed die box 74 to be adjusted for different applications. A person skilled in the art will recognize that screed die box 74 could alternatively be anchored to frame 12 by other flexible or inflexible means, and that screed die box anchor 84 could accordingly take other forms which equivalently allow screed die box 74 to be secured to frame 12. Screed die box anchor 84 may double as a handle used by operators to install, remove, and transport screed die box 74.

Screed die box lever 78 attaches to screed die box gate 82. The screed die box gate is a slidable plate along the bottom of screed die bucket 80. Screed die box lever 78 is detachably attached to screed actuator link 56 by means of retention pin 86, and is fastened to screed die box gate 82. When screed actuator lever 58 (shown in FIG. 2) is pulled or pushed, a torque is applied to screed die box lever 78 via screed actuator link 56, which opens or closes screed die box gate 82. Screed die box gate 82 opens and closes by shifting forward or afterward to create or remove an open space in the bottom of screed die box bucket 80. Screed die box 74 may have a plurality of distinct embodiments with different dimensions and additional features for use in different applications, any of which may be freely swapped in and out of mobile applicator 10 by fastening screed die box 74 to frame 12 using screed die box anchor 84, and attaching screed die box lever 78 to screed actuator link 56 with retention pin 86.

Also shown in FIG. 3, bead dispenser 72 is attached to frame 12 and supports aft screed burners 62*a*. Bead dispenser 72 receives and deposits visibility-enhancing beads from bead tube 70, as understood in the art. In addition, fore burners 62*b* are supported by frame 12 and are located forward of screed die box 74.

Screed die box 74 is heated by screed burners 62, to ensure that thermoplastic deposited in screed die box 74 from chute 44 remains molten during the application process. As stated previously, all screed burners 62 receive combustible gas from gas system 18. Screed burners 62 include aft screed burners 62*a*, which are directed to an aft portion of screed die box 74, and fore screed burners 62*b*. Although the embodiment of mobile applicator 10 depicted in FIG. 3 includes four aft screed burners 62*b* and three fore screed burners, a person skilled in the art will understand that the number and placement of screed burners may be varied without departing from the spirit of the present invention. In particular, some embodiments of mobile applicator 10 may not include aft screed burners 76. Alternatively, one or both of aft and fore screed burners 62*a* and 62*b*, respectively, may be modular components which may be connected to gas system 18 if and when desired. As shown in FIG. 3, two of fore screed burners 62*b* are directed to a fore portion of screed die box 74 near where screed die box anchor 84 attaches to screed die box bucket 80, while a third screed burner 62*b* is directed at chute 44 to prevent thermoplastic from solidifying in chute 44. As depicted, all screed burners are ignited manually, although a person skilled in the art will recognize that automatic ignition tools such as electrical sparkers may be utilized instead.

The components and configuration of mobile applicator 10 as shown in FIG. 3 allow for molten thermoplastic to be applied to pavement. Screed burners 62 heat die box 74 and chute 44, allowing molten thermoplastic to flow smoothly from kettle 14 into screed die box 74 and maintaining thermoplastic in screed die box 74 in a molten state. By pulling screed actuator lever 58 (shown in FIG. 2), an operator can deposit molten thermoplastic from screed die box 74 onto a pavement surface.

As noted above in the Background of the present invention, flames from combustible gasses such as propane and butane can be hard to see, particularly in conditions of bright sunlight. Consequently, it can be difficult to visually ascertain whether screed burners 62 (or, potentially, hand torch 64) are lit. To reduce the risk of undetected gas leakage from an unlit burner, screed burners 62 are fitted with flame indicators, as described below with respect to FIGS. 7 and 9.

Figure 4:
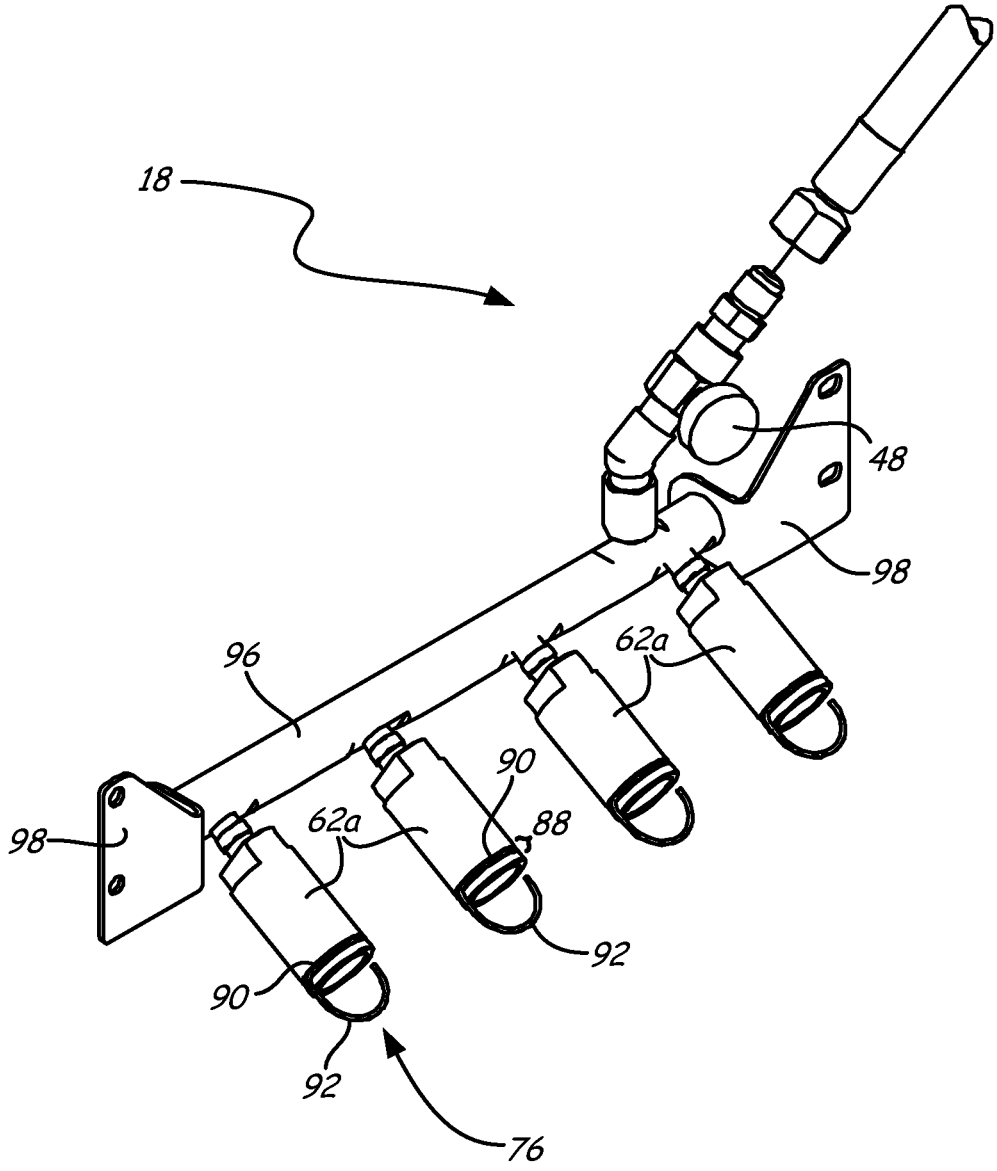
FIG. 4 is a perspective view of several die box burners of the mobile applicator of FIG. 1.

FIG. 4 depicts a portion of gas system 18 including screed burners 62*a* with grooves 88. Aft screed burners 62*a* are anchored to and receive gas from manifold 96, which is attached to beat dispenser 72 (not shown; see FIG. 3 above) via mounting brackets 98. Each aft screed burner 62*a* is fitted with a flame indicators 76 having attachment ring 90 and flame path portion 92. Attachment ring 90 snaps into groove 88, securing flame indicator 76 to aft screed burner 62*a* such that flame path portion 92 extends into the path of the gas jet projected from aft screed burner 62*a*. When this gas is ignited, flame from aft screed burner 62*a* heats flame path portion 92 of flame indicator 76, causing it to incandescently glow, This glow improves flame visibility. Although flame indicator 76 is described herein with reference to aft screed burners 62*a*, a person skilled in the art will recognize that flame indicator 76 may also be used on other burners where flame visibility is normally limited, including on hand torch 64 and fore screed burners 62*b*.

Figure 5:
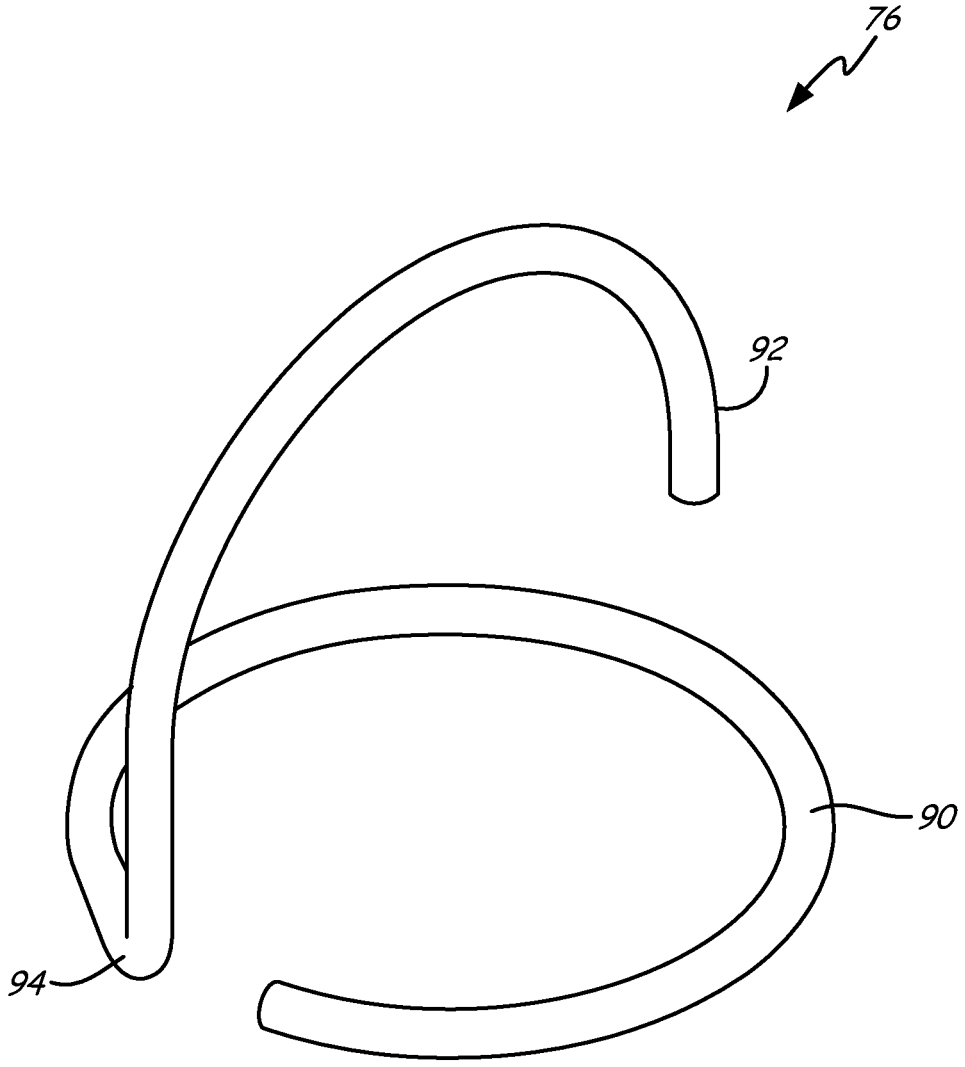
FIG. 5 is a perspective view of a flame indicator for the die box burners of FIG. 10.

FIG. 5 depicts flame indicator 76, comprising attachment ring 90, flame path portion 92, and turn 94. Attachment ring 90 is a snap ring which deforms to snap into groove 88, anchoring flame indicator 76 to aft screed burner 62*a* (see FIG. 4). Flame path portion 92 is formed of a metallic alloy such as inconel or stainless steel, which changes color or incandescently glows when heated to sufficient temperatures. In some embodiments, flame path portion 92 incandescently glows red. Attachment ring 90 deforms to snap into groove 88, securing flame indicator 76 to screed burner 62*a*.

As depicted in FIG. 5, flame indicator 76 is comprised of a single piece of wire bent into attachment ring 90 and flame path portion 92, with attachment ring 90 meeting flame path portion 92 at substantially a right angle at turn 94. This embodiment is both inexpensive and easily manufactured. In alternative embodiments, however, flame path portion 92 and attachment ring 90 may be separate pieces, potentially of different materials, which are welded or otherwise joined together.

Flame indicators 76 improve visibility of flames from screed die burners 62, reducing the risk that gas will escape undetected from unlit burners, and accumulate in hazardous quantity. Flame indicators 76 accordingly improve fire safety, and are both easily manufactured and inexpensive to produce.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A mobile thermoplastic applicator, comprising:

a thermoplastic melting kettle configured to melt granular thermoplastic;

a screed die configured to receive molten thermoplastic from the thermoplastic melting kettle, and deposit the received molten thermoplastic on a surface;

a screed die burner configured to expel a jet of pressurized combustible gas from an outlet nozzle directed at the screed die, such that the jet of pressurized combustible gas forms a torch which heats the screed die, when ignited; and a flame indicator attached to the screed die burner near the outlet nozzle, the flame indicator comprising:

an attachment ring securing the flame indicator to the screed die burner; and a flame path portion formed of a material selected to incandescently glow when heated, and extending from the attachment ring to adjacent the outlet nozzle.

2. The mobile thermoplastic applicator of claim 1, wherein the screed die burner includes a groove near the outlet nozzle, and attachment ring secures the flame indicator to the screed die burner by snapping into groove.

3. The mobile thermoplastic applicator of claim 1, wherein the flame path portion is formed from of Inconel.

4. The mobile thermoplastic applicator of claim 1, wherein the flame path portion is formed from of stainless steel.

5. The mobile thermoplastic applicator of claim 1, wherein the attachment ring and the flame path portion are formed of a single common piece.

6. The mobile thermoplastic applicator of claim 5, wherein the single common piece is a bent wire of stainless steel or Inconel.

7. The mobile thermoplastic applicator of claim 1, wherein the flame path portion changes visibly by incandescently glowing when heated by the torch.

8. The mobile thermoplastic applicator of claim 7, wherein the flame path portion incandescently glows red.

9. The mobile thermoplastic applicator of claim 1, wherein the pressurized combustible gas is propane or butane.

10. A flame safety system for a thermoplastic applicator, the flame safety system comprising:

a gas burner configured to expel a jet of pressurized combustible gas from an outlet nozzle, and having an attachment groove near the nozzle; and a flame indicator for visually ascertaining whether the jet of pressurized combustible gas is ignited, the flame indicator comprising:

an attachment ring configured to fit into the groove, thereby securing the flame indicator to the gas burner; and a flame path portion formed of a material selected to incandescently glow when heated, and extending from the attachment ring to adjacent the outlet nozzle.

11. The flame safety system of claim 10, wherein the material which changes color and incandescently glows when heated is Inconel.

12. The flame safety system of claim 10, wherein the material which changes color and incandescently glows is stainless steel.

13. The flame safety system of claim 10, wherein the pressurized combustible gas is propane or butane.

14. The flame safety system of claim 10, wherein the attachment ring and the flame path portion are formed of a single common piece.

15. The flame safety system of claim 14, wherein the single common piece is a bent wire of Inconel or stainless steel.

16. The flame safety system of claim 10, wherein the flame indicator is detachable from the gas burner, and the attachment ring is configured to be snapped into and out of the groove.

17. A method for visually ascertaining whether a jet of pressurized combustible gas from a gas burner is lit, the method comprising:

attaching a flame indicator with an attachment ring and a flame path portion to the gas burner by snapping the attachment ring into a groove of the gas burner, such that the flame path portion extends into the jet of pressurized combustible gas; and detecting an incandescent glow from the flame path portion whenever the flame path portion is exposed to flame.

18. The method of claim 17, wherein the flame path portion is formed of Inconel or stainless steel.

19. The method of claim 17, wherein the attachment ring and the flame path portion are formed of a single common piece.

20. The method of claim 17, wherein the flame path portion incandescently glows red.

* * * * *